US007237413B2

(12) United States Patent
Monahan et al.

(10) Patent No.: US 7,237,413 B2
(45) Date of Patent: Jul. 3, 2007

(54) SETTING TOOL

(75) Inventors: Patrick Monahan, Rockton, IL (US); Scott Anderson, Rosco, IL (US)

(73) Assignee: Acument Intellectual Properties LLC, Troy, MI (US)

( * ) Notice: Subject to any disclaimer, the term of this patent is extended or adjusted under 35 U.S.C. 154(b) by 0 days.

(21) Appl. No.: 11/380,056

(22) Filed: Apr. 25, 2006

(65) Prior Publication Data

US 2006/0236742 A1 Oct. 26, 2006

Related U.S. Application Data

(60) Provisional application No. 60/674,909, filed on Apr. 26, 2005.

(51) Int. Cl.
*B21J 15/34* (2006.01)
*B21D 39/04* (2006.01)

(52) U.S. Cl. ..... 72/114; 72/391.8; 29/243.526

(58) Field of Classification Search ..... 72/114, 72/391.8; 29/243.526
See application file for complete search history.

(56) References Cited

U.S. PATENT DOCUMENTS 2,562,419 A * 7/1951 Ferris ..... 29/243.519
3,263,466 A * 8/1966 Shackelford ..... 72/114
3,367,017 A 2/1968 Evdokimoff
3,462,988 A 8/1969 Tudor et al.
3,472,052 A 10/1969 Chance
3,574,915 A 4/1971 Jeal
3,587,271 A 6/1971 Rigot
3,654,792 A 4/1972 Mead
3,686,914 A 8/1972 Powsey
3,686,915 A 8/1972 Miller et al.
3,728,882 A 4/1973 Rigot et al.
3,762,200 A 10/1973 Still
3,838,499 A 10/1974 Fuller
3,838,588 A 10/1974 Johnson
3,861,014 A 1/1975 Summerlin
3,861,185 A 1/1975 Maddox
3,871,203 A 3/1975 Wellin
3,933,019 A 1/1976 Underland et al.
4,038,851 A 8/1977 Coloma
4,070,889 A 1/1978 DeCaro
4,074,554 A 2/1978 Summerlin
4,086,799 A 5/1978 Brendle
4,118,966 A 10/1978 Jackson
4,121,444 A 10/1978 Duran
4,140,000 A 2/1979 Ehmann (Continued)

*Primary Examiner*—David Jones
(74) *Attorney, Agent, or Firm*—Trexler, Bushnell, Giangiorgi, Blackstone & Marr, Ltd.

(57) ABSTRACT

A tool and method for installing collapsible inserts. The tool includes a stabilizing handle which is threaded onto a tool body. The tool body is threaded onto a tool shaft. In use, a collapsible insert is threaded onto the tool and the insert is positioned in a hole in a workpiece. An actuating handle of the tool is then rotated, while holding the stabilizing handle, to cause the collapsible insert to collapse, thereby installing the insert relative to the workpiece. Once the insert has been collapsed using the tool, the actuating handle is rotated in the opposite direction, while holding the stabilizing handle, to disengage the tool from the insert. Then, a hanger is threadably inserted into the collapsed insert and a threaded rod is threaded into the hanger. Alternatively, the threaded rod is directly threadably engaged with the collapsed insert, without need for a hanger.

12 Claims, 14 Drawing Sheets

U.S. PATENT DOCUMENTS

| | | | |
|---|---|---|---|
| 4,147,047 | A | 4/1979 | Fluester |
| 4,192,163 | A | 3/1980 | Martin |
| 4,201,072 | A | 5/1980 | Snell |
| 4,229,960 | A | 10/1980 | Nilsson |
| 4,285,225 | A | 8/1981 | Snell |
| 4,289,010 | A | 9/1981 | Badger |
| 4,307,598 | A | 12/1981 | Andrich |
| 4,321,814 | A | 3/1982 | Martin |
| 4,368,631 | A | 1/1983 | Tanikawa |
| 4,400,960 | A | 8/1983 | Martin |
| 4,402,203 | A | 9/1983 | Molina |
| 4,425,782 | A | 1/1984 | Todisco |
| 4,559,806 | A | 12/1985 | Schwab |
| 4,571,976 | A | 2/1986 | Schwab |
| 4,574,612 | A | 3/1986 | Tanikawa |
| 4,612,793 | A | 9/1986 | Klein |
| 4,649,732 | A | 3/1987 | Molina |
| 4,698,993 | A | 10/1987 | Fulier |
| 4,821,555 | A | 4/1989 | Kamata et al. |
| 4,869,629 | A | 9/1989 | Witzigman |
| 4,910,992 | A | 3/1990 | Stenberg et al. |
| 4,914,933 | A | 4/1990 | Schepergerdes |
| 4,979,279 | A | 12/1990 | Garvey |
| 5,079,818 | A | 1/1992 | Schwab |
| 5,131,255 | A | 7/1992 | Fushiya et al. |
| 5,299,442 | A | 4/1994 | Graham |
| 5,605,070 | A | 2/1997 | Wille |
| 5,729,880 | A | 3/1998 | Ko |
| 5,771,738 | A | 6/1998 | Ko |
| 5,802,691 | A | 9/1998 | Zoltaszek |
| 6,029,332 | A | 2/2000 | Schruff |
| 6,212,931 | B1 | 4/2001 | Solfronk |
| 6,272,899 | B1 | 8/2001 | Bentivogli |
| 6,415,490 | B1 | 7/2002 | Caruso et al. |
| 6,427,514 | B1 | 8/2002 | Thiede |
| 6,447,399 | B1 | 9/2002 | Denham |
| 6,474,129 | B1 | 11/2002 | Anquetin |
| 6,691,546 | B1 | 2/2004 | Kovalik |
| 6,732,563 | B1 | 5/2004 | Chen |
| 6,840,075 | B2 | 1/2005 | Neri et al. |
| 6,907,649 | B2 | 6/2005 | Yamada |

* cited by examiner

SETTING TOOL

PRIOR APPLICATION (PRIORITY CLAIM)

This application claims the benefit of U.S. Provisional Application Ser. No. 60/674,909, filed Apr. 26, 2005, which is hereby incorporated herein by reference in its entirety.

BACKGROUND

The present invention generally relates to tools and methods for installing one-piece blind fasteners, such as collapsible inserts, in a workpiece, which inserts are preferably internally threaded. The present invention more specifically relates to a hand tool and associated method for installing collapsible inserts.

The present invention is directed at a tool and associated method for installing one-piece blind fasteners, and specifically collapsible inserts such as is disclosed in U.S. Pat. No. 4,869,629, hereby incorporated herein by reference in its entirety. U.S. Pat. No. 6,447,399 discloses a method of making such a collapsible insert, and that patent is also hereby incorporated herein by reference in its entirety. As described in the '629 patent, such collapsible inserts are typically used to join workpieces. Specifically, the collapsible insert is located on a tool and is inserted in a hole in a workpiece, and then the tool is actuated causing the insert to collapse on the blind side of the hole and become installed relative to the workpiece. The insert, as shown in the accompanying drawings, is internally threaded to facilitate attachment to an externally threaded element such as a rod, bolt or similar type of fastener or mounting component. Subsequently, the tool is disengaged from the insert and the second externally threaded component is threaded into, or otherwise engaged with, the insert. If a second insert is threaded into the first insert, then the workpiece is threaded into the second insert.

One application of use for such collapsible inserts is in the construction industry where the collapsible inserts are installed in metal decking. Specifically, the collapsible insert is located on a tool and is inserted in a hole in the metal decking. Then, the tool is actuated, causing the insert to collapse or deform on the blind side of the hole and become installed relative to the metal decking. Subsequently, the tool is disengaged from the collapsed insert and a threaded component is threaded into the insert. Depending upon size, the threaded component may be a section of metal rod, or an intermediate component with an internally threaded bore, into which the threaded rod is engaged.

Presently, expensive and somewhat complex automated equipment is used to install such inserts in a factory environment. The equipment which is typically used to install such collapsible inserts is impractical for use on the construction job site, due to the equipment being large and cumbersome. As such, it has not been possible to install such inserts quickly and easily at a construction job site. There is a need for a simple, inexpensive installation tool for these collapsible inserts.

OBJECTS AND SUMMARY

An object of an embodiment of the present invention is to provide a hand tool and associated method for installing collapsible inserts, such as that which is disclosed in U.S. Pat. Nos. 4,869,629 and 6,447,399.

Another object of an embodiment of the present invention is to provide a hand tool and associated method such that it is possible to quickly, easily and economically install inserts, such as that which is disclosed in U.S. Pat. Nos. 4,869,629 and 6,447,399, at a construction job site, without having to use heavy, expensive automated equipment.

Yet another object of an embodiment of the present invention is to provide that collapsible inserts, such as that which is disclosed in U.S. Pat. Nos. 4,869,629 and 6,447,399, can be installed at a construction job site environment at a minimal tool cost.

Briefly, and in accordance with at least one of the foregoing objects, an embodiment of the present invention provides a tool for installing collapsible inserts. The tool includes a stabilizing handle which is threaded onto a tool body with preferably a left hand thread. The tool body is, in turn, threaded onto a tool shaft which includes a second handle, referred to as an actuating handle, and a threaded end portion. In use, a collapsible insert is threaded onto the tool shaft end portion, and the insert is positioned in a hole in a workpiece. The actuating handle of the tool is then rotated, while holding the stabilizing handle, to cause the threaded end, with the collapsible insert attached, to rotate relative to the insert, wherein the end of the insert moves axially relative to the threaded end, thus causing the insert to collapse, thereby installing the insert relative to the workpiece. Once the insert has been collapsed using the tool, the actuating handle is rotated in the opposite direction, while holding the stabilizing handle, to disengage the threaded end portion of the tool from the insert. In the preferred embodiment, the thread on the stabilizing handle and that on the tool body, to which the stabilizing handle is engaged, are left hand threads. With this arrangement, the rotation of the actuating handle can be clockwise and will produce collapsing of the insert with preferably three (3) to four (4) revolutions and subsequent removal of the tool with preferably approximately seven (7) revolutions.

BRIEF DESCRIPTION OF THE DRAWINGS

The organization and manner of the structure and operation of the invention, together with further objects and advantages thereof, may best be understood by reference to the following description, taken in connection with the accompanying drawings (not to scale), wherein like reference numerals identify like elements in which.

DESCRIPTION

Figure 1:
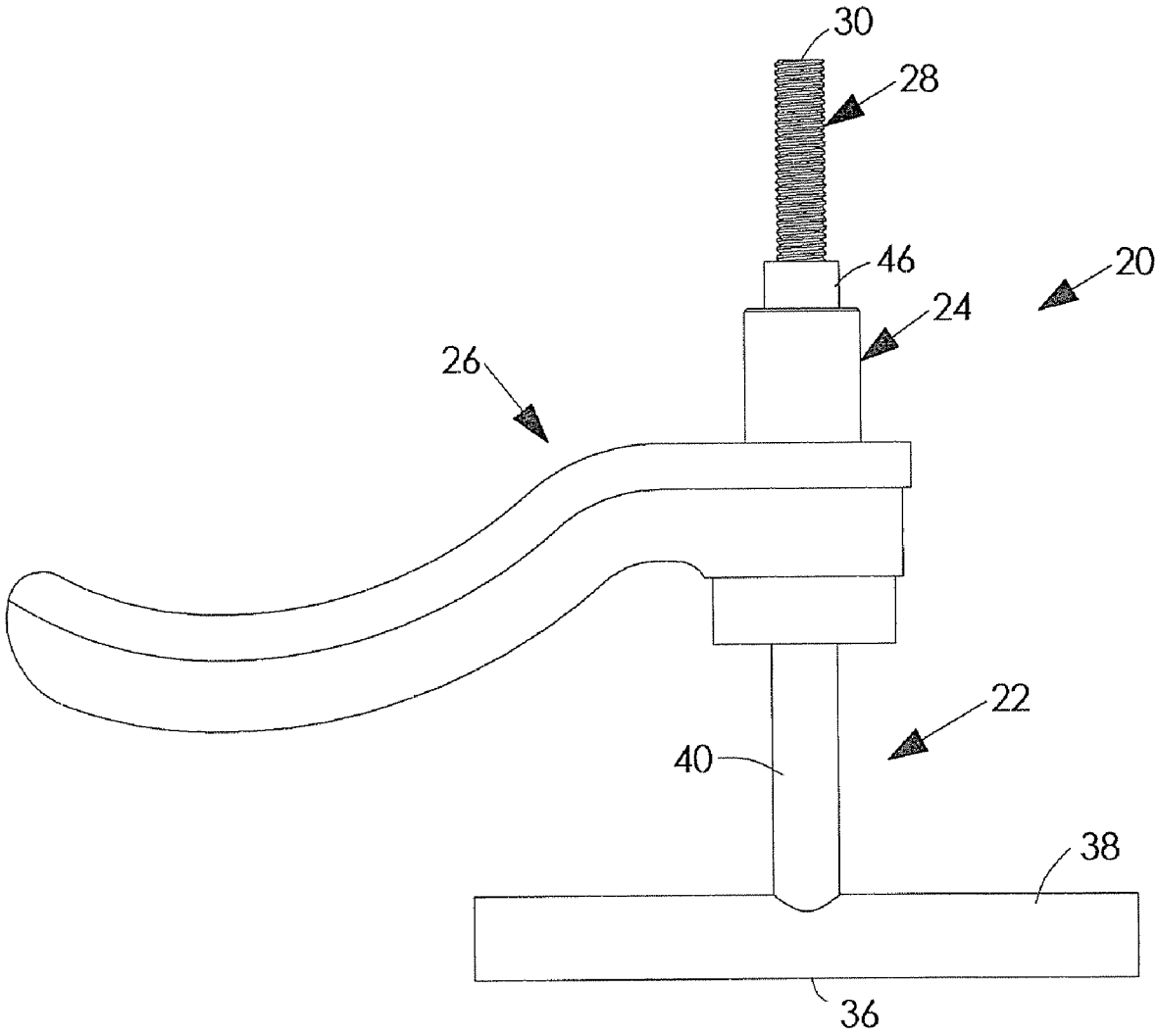
FIG. 1 is a side view of an installation tool which is in accordance with an embodiment of the present invention.

While the present invention may be susceptible to embodiment in different forms, there are shown in the drawings, and herein will be described in detail, embodiments thereof with the understanding that the present description is to be considered an exemplification of the principles of the invention and is not intended to limit the invention to that as illustrated and described herein.

An embodiment of the present invention provides a hand tool 20 and associated method for installing collapsible inserts, such as that which is disclosed in U.S. Pat. Nos. 4,869,629 and 6,447,399. As such, it is possible to quickly and easily install the inserts at a construction job site, with minimal tool cost, and without having to use heavy, expensive automated equipment.

As shown in FIG. 1, the tool 20 consists of the following components: a tool shaft 22, a tool body or sleeve 24, and a stabilizing handle 26, wherein the tool body 24 is threadably engaged with both the tool shaft 22 and the stabilizing handle 26.

Figure 2:
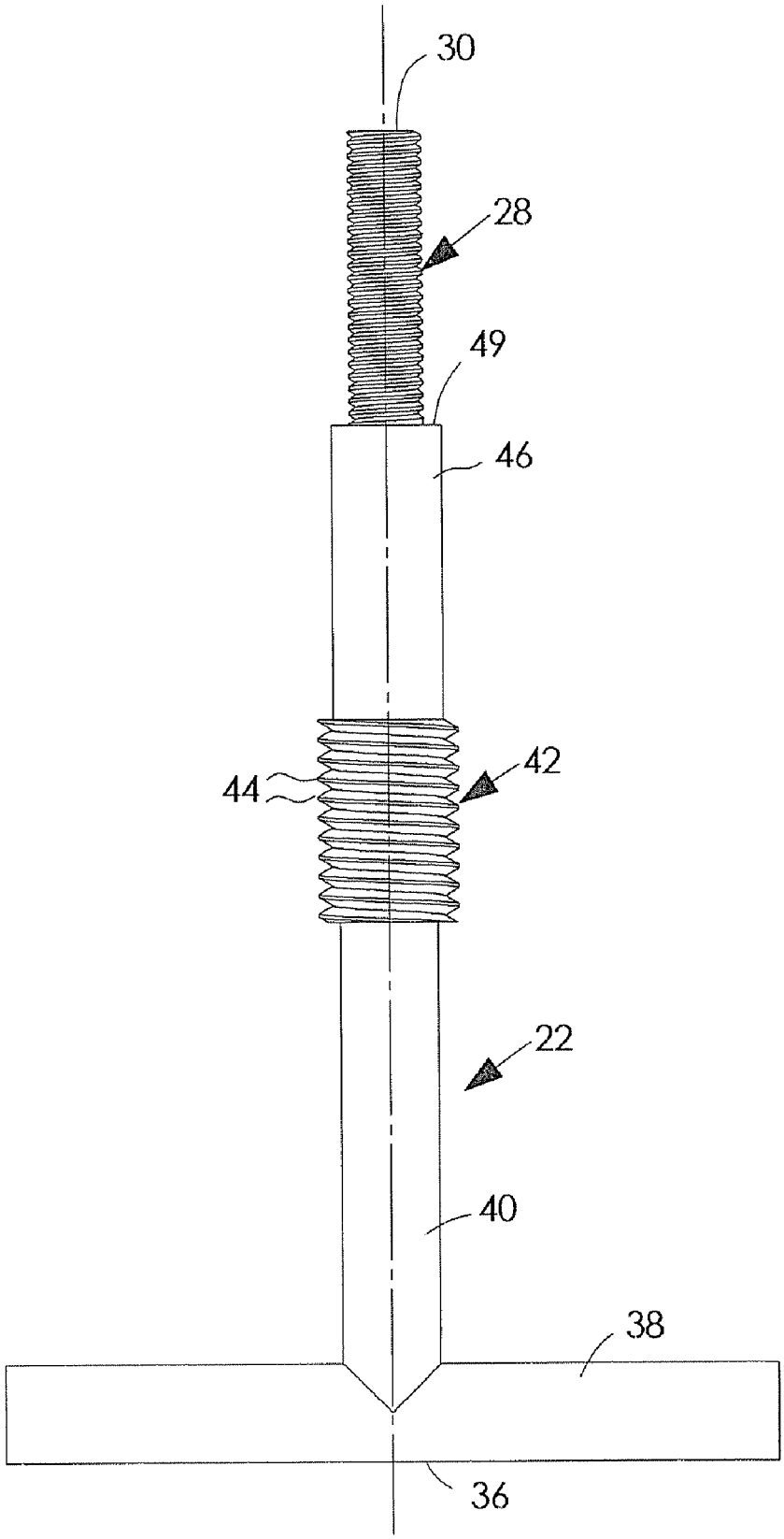
FIG. 2 is a side view of a tool shaft component of the installation tool which is shown in FIG. 1.

As shown in FIG. 2, the tool shaft 22 includes a threaded portion 28 proximate one end 30. Specifically, the threaded portion 28 may consist of male ¼-20 right hand threads which are configured to engage corresponding female threads 32 in a collapsible insert 34, as will be described later herein. At the opposite end 36 of the tool shaft 22 is a T-handle portion 38. While the Figures illustrate the handle portion 38 being integral with the shaft portion 40, it is possible to provide that the handle portion 38 is a separate piece which is secured to the shaft portion 40. The tool shaft 22 also includes another threaded portion 42, which preferably consists of left hand threads 44, and an enlarged diameter portion 46 between the two threaded portions 28 and 42. The enlarged diameter portion 46 is preferably unthreaded.

Figure 3:
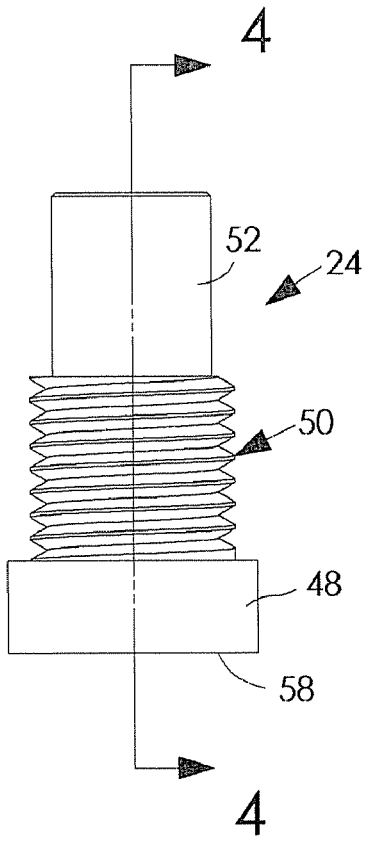
FIG. 3 is a side view of a tool body or sleeve component of the installation tool which is shown in FIG. 1.
Figure 4:
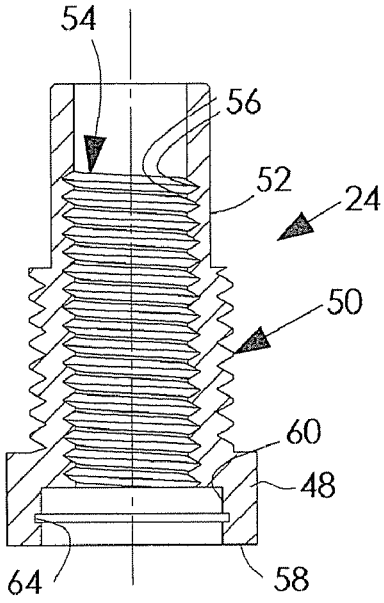
FIG. 4 is a cross-sectional view of the tool body shown in FIG. 3, taken along line 4-4 of FIG. 3.

As shown in FIGS. 3 and 4, the tool body or sleeve 24 is generally cylindrical and includes an enlarged head portion 48, which provides a shoulder 49, as well as an external threaded portion 50 along at least part of its external surface 52. As shown in FIG. 4, the tool body 24 also includes an internal threaded portion 54. Preferably, the internal threaded portion 54 includes left hand threads 56 much like the threaded portion 42 of the tool shaft 22. While the external threaded portion 50 of the tool body 24 is configured to threadably receive the stabilizing handle 26, the internal threaded portion 54 of the tool body 24 is configured to threadably receive the threaded portion 42 which is on the tool shaft 22. As will be discussed below, the fact that the threaded portion 42 on the tool shaft 22 and the internal threaded portion 54 of the tool body 24 includes left hand threads 44, 56 provides that the T-handle 38 is rotated clockwise, as opposed to having to be rotated counter-clockwise, to collapse the collapsible insert 34. As also shown in FIG. 4, proximate an end 58 of the tool body 24 is a space 60 for receiving a retaining ring (not shown) as well as a groove 64 for receiving a snap ring (not shown). The retaining ring is used to contain and stabilize the tool shaft 22 in the tool body 24, and may comprise a conventional flat washer. The snap ring is used to contain the retaining ring in the tool body 24.

Figure 5:
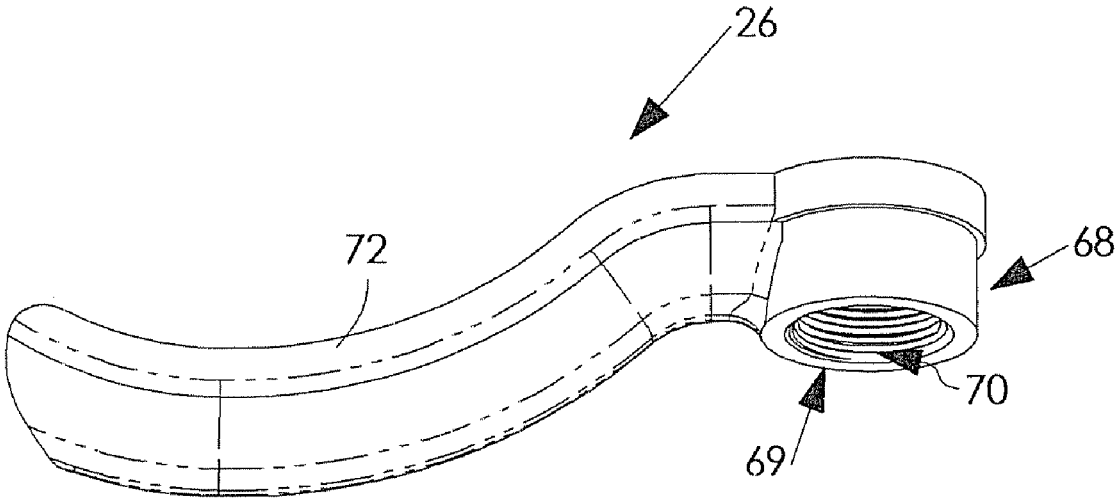
FIG. 5 is a perspective view of a stabilizing handle component of the installation tool which is shown in FIG. 1.
Figure 6:
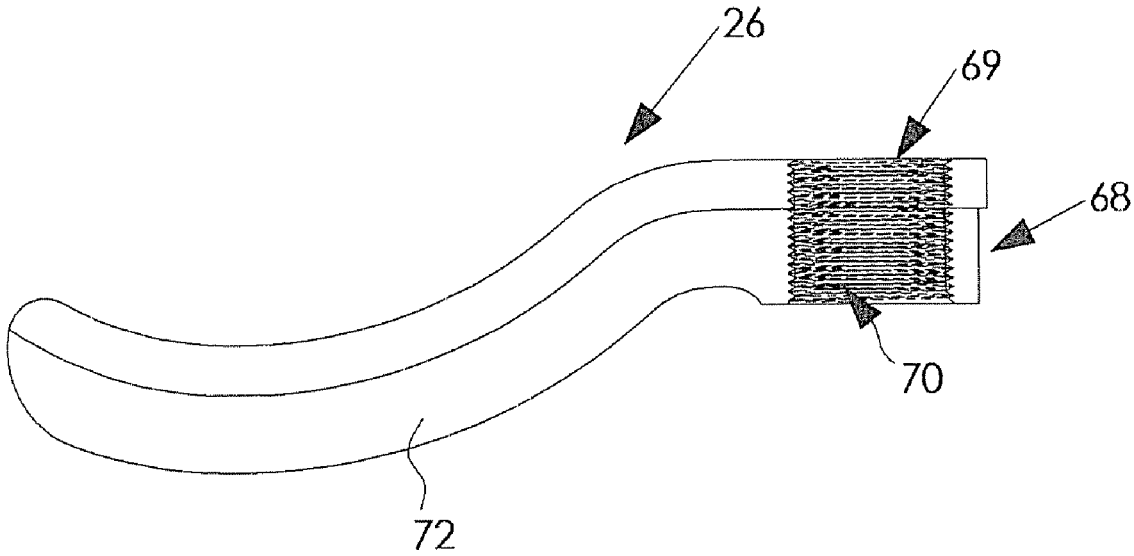
FIG. 6 is a side view of the stabilizing handle shown in FIG. 5.

FIGS. 5 and 6 illustrate the stabilizing handle component 26 of the tool 20. As shown, the handle 26 includes a cylindrical portion 68 which includes throughbore 69 having an internal thread 70. A handle portion 72 extends from the cylindrical portion 68 and is configured for gripping by a user during collapsing of the collapsible insert 34, as will be described in more detail hereinbelow. The internal thread 70 of the handle component 26 is configured for threadably engaging the external thread portion 50 which is provided on the tool body 24 (see FIGS. 1, 3, 4 and 7).

Figure 7:
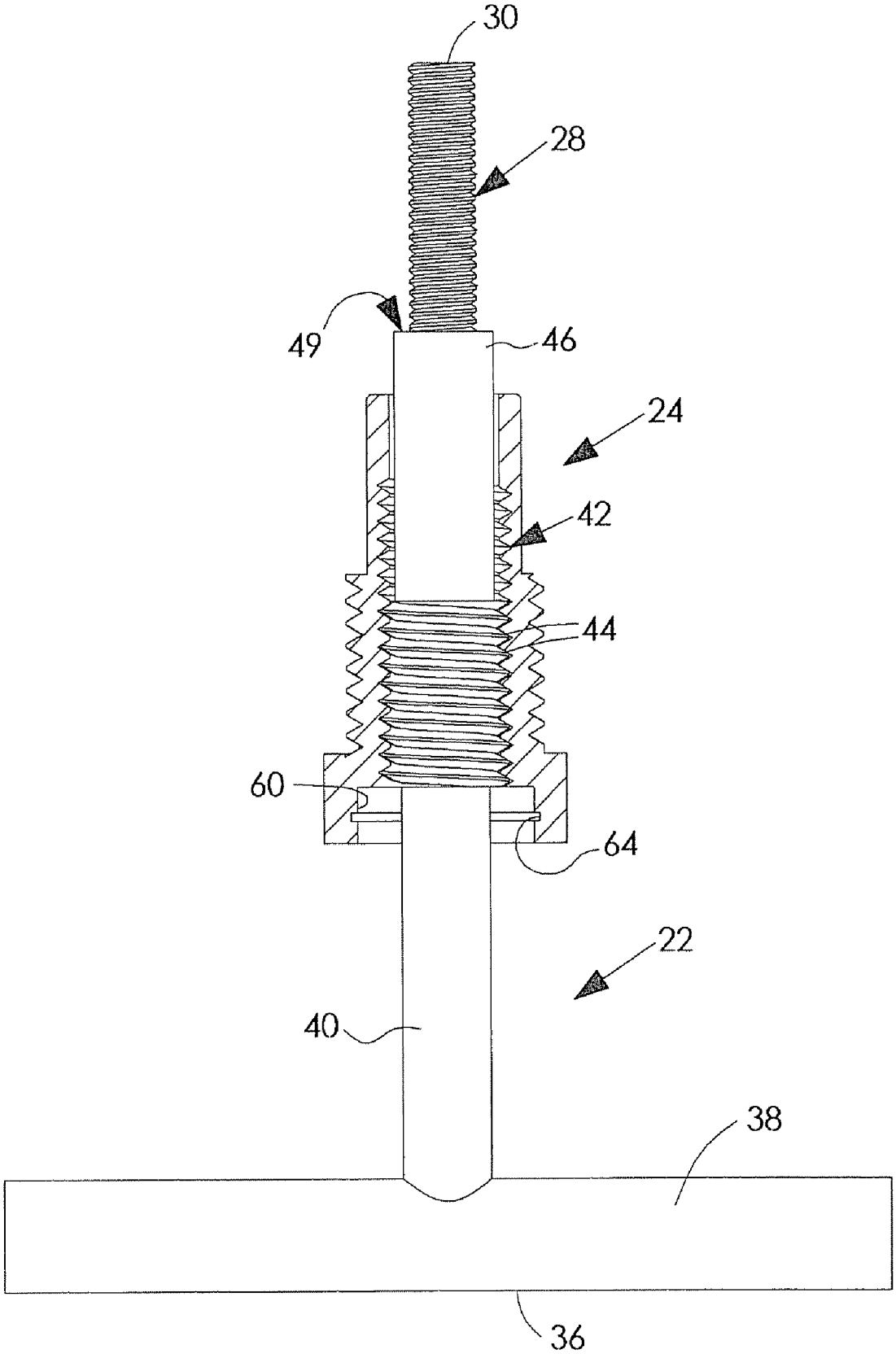
FIG. 7 is a view showing the tool shaft threadably engaged in the tool body, wherein the tool body is shown in cross-section.

To assemble the tool 20, the shaft portion 40 of the tool shaft 22 is inserted through the snap ring and retaining ring, and the tool shaft 22 is threaded into the tool body 24, as shown in FIG. 7. Then, the retaining ring and snap ring are engaged in the space 60 and groove 64 in the tool body 24, and the stabilizing handle 26 is threaded onto the tool body 24, such that the tool 20 is as shown in FIG. 1.

Figure 8:
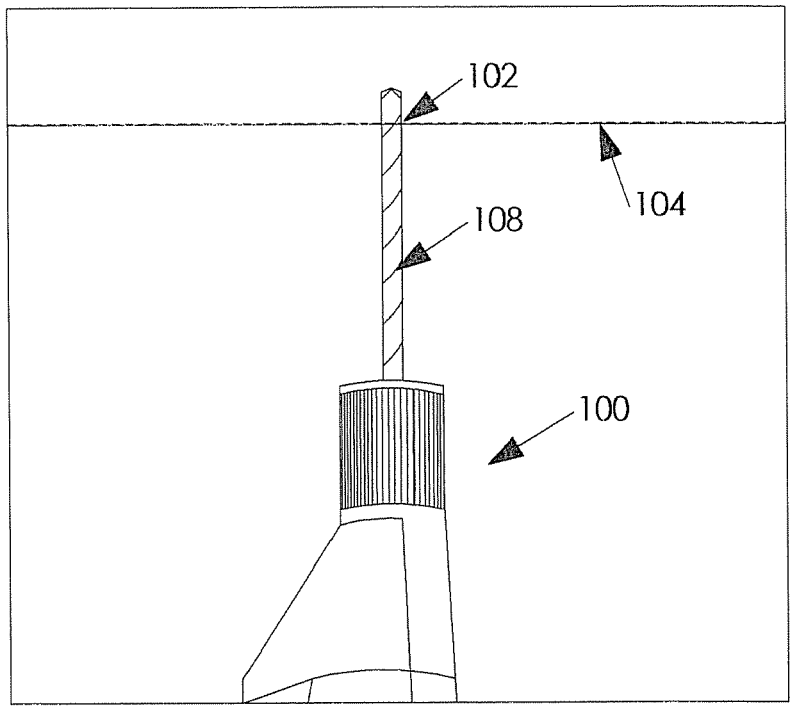
FIGS. 8 shows the first step of a method which is in accordance with an embodiment of the present invention, wherein a conventional drill is used to drill a hole in a workpiece.
Figure 9:
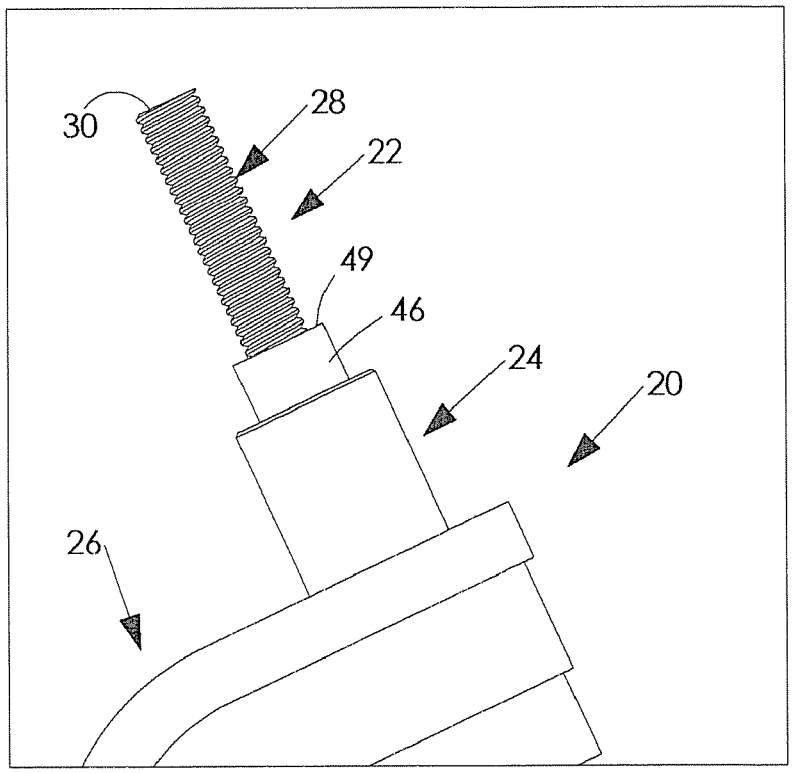
FIG. 9 shows a subsequent step of the method, wherein the tool shaft is rotated until a threaded shaft portion extends fully out of the tool body.
Figure 10:
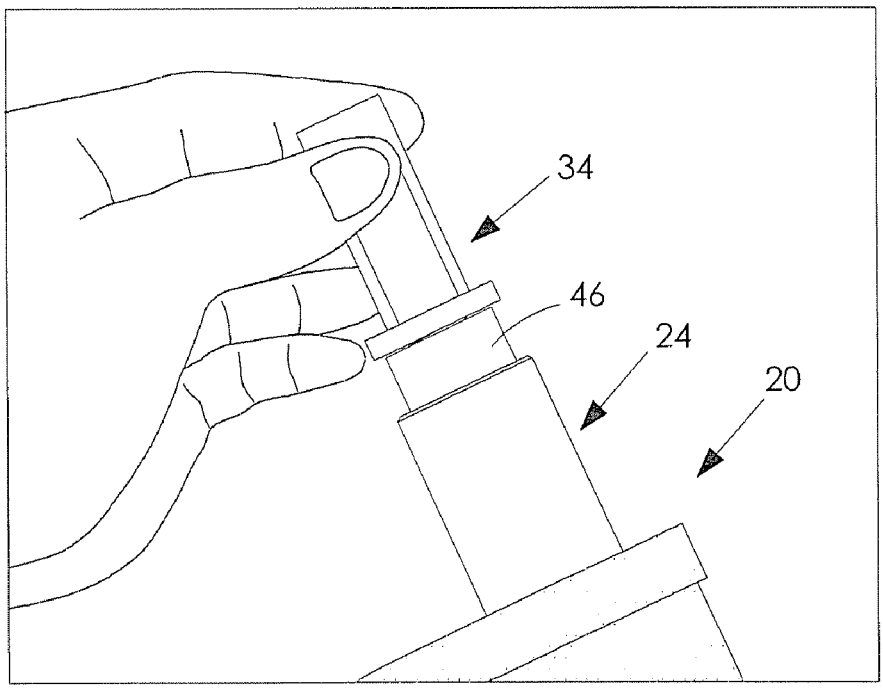
FIG. 10 shows a subsequent step of the method, wherein a collapsible insert is threaded onto the threaded shaft portion of the tool shaft until the collapsible insert contacts an enlarged portion of the tool shaft.
Figure 11:
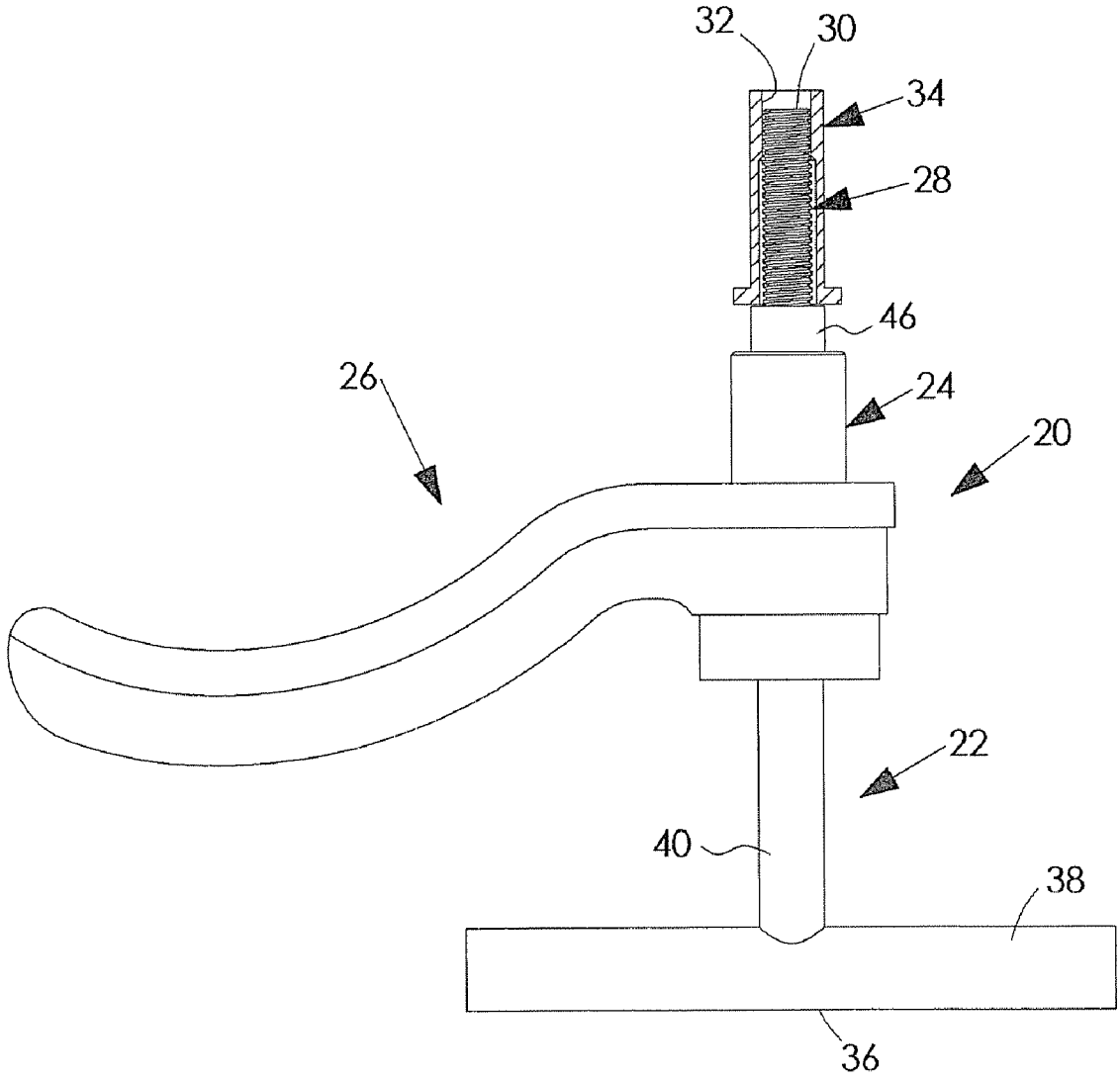
FIG. 11 provides a larger view which shows the collapsible insert in contact with the enlarged portion of the tool shaft, and showing the insert in cross-section.

A method of using the tool 20 to install a collapsible insert 34 (i.e., to collapse the insert such that the insert becomes installed in a workpiece) will now be described. As shown in FIG. 8, initially a conventional drill 100 is used to drill a hole 102 in a workpiece 104, taking care not to over-penetrate. For example, a 25/64 inch drill bit 108 may be used to drill a hole in steel. Once the hole 102 has been drilled, the handle 38 of the tool shaft 22 of the tool 20 is rotated until the threaded shaft portion 28 extends fully out of the tool body 24, as shown in FIG. 9. Next, as shown in FIG. 10, a collapsible insert 34, such as a collapsible insert which is consistent with U.S. Pat. No. 4,869,629 and U.S. Pat. No. 6,447,399, is threaded onto the threaded shaft portion 28 of the tool shaft 22 until the collapsible insert 34 contacts the enlarged diameter portion 46 of the tool shaft 22. As such, the enlarged diameter portion 46 of the tool shaft 22 acts as a mechanical stop when the collapsible insert 34 is threaded onto the threaded portion 28 at the end 30 of the tool shaft 22. FIG. 11 shows the collapsible insert 34 in contact with the enlarged diameter portion 46 of the tool shaft 22.

Figure 12:
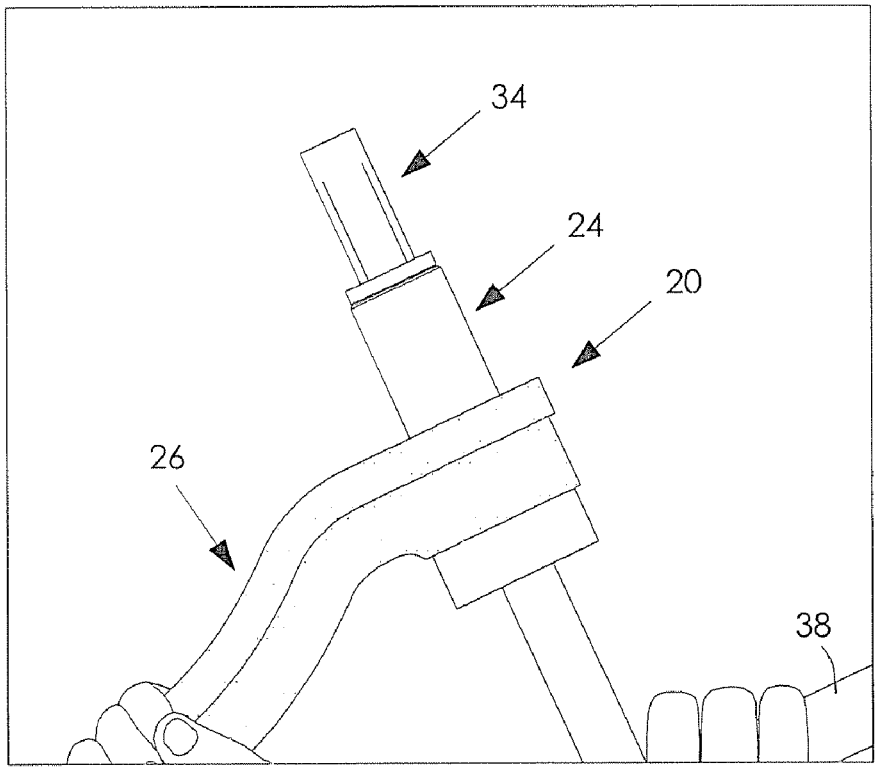
FIG. 12 shows a subsequent step of the method, wherein the tool shaft is rotated until the collapsible insert contacts the tool body.
Figure 13:
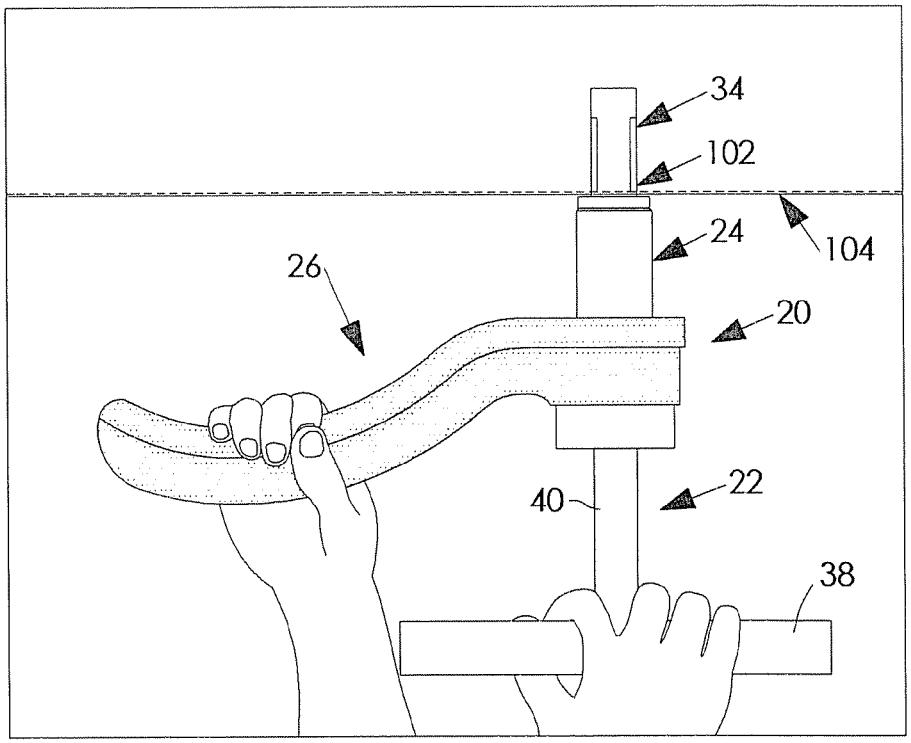
FIG. 13 shows a subsequent step of the method, wherein the tool is used to insert the collapsible insert into the hole which has been drilled in the workpiece.
Figure 14:
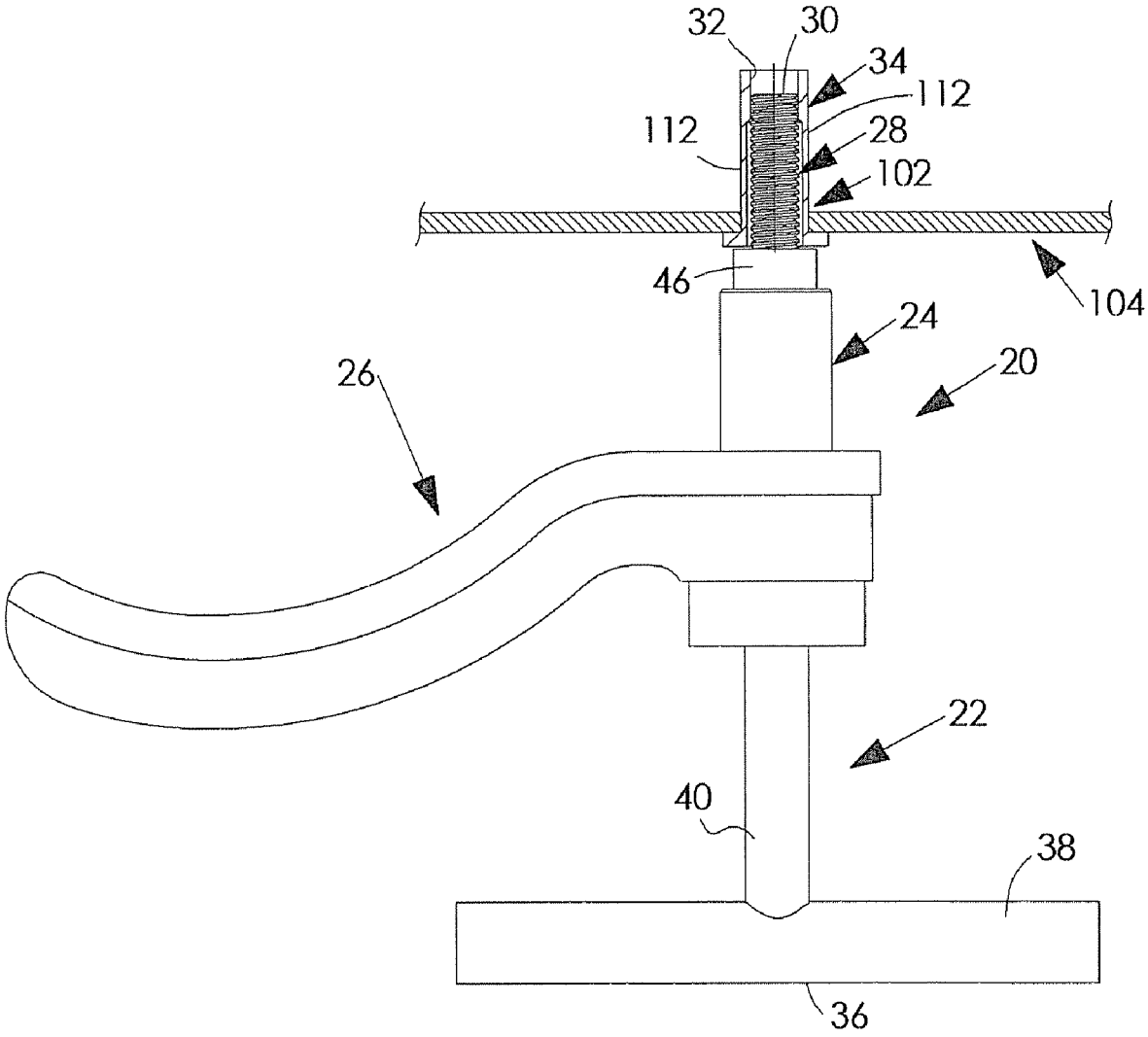
FIG. 14 provides a larger view which shows the collapsible insert inserted into the hole in the workpiece, and showing the insert in cross-section.

Subsequently, as shown in FIG. 12, the handle 38 of the tool shaft 22 is rotated, while holding the stabilizing handle 26, until the collapsible insert 34 contacts the tool body 24. Then, as shown in FIG. 13, the tool 20 is used to insert the collapsible insert 34 into the hole 102 which has been drilled in the workpiece 104. FIG. 14 provides a larger view of the collapsible insert 34 inserted into the hole 102 in the workpiece 104.

Figure 15:
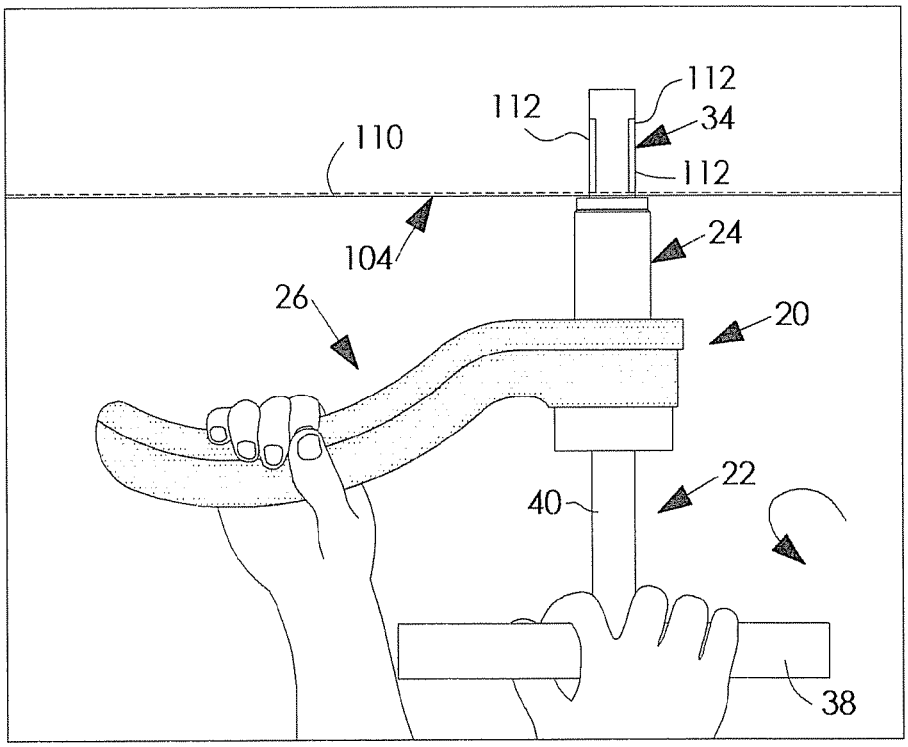
FIG. 15 shows a subsequent step of the method, wherein the tool shaft is being rotated to cause the collapsible insert to collapse.
Figure 16:
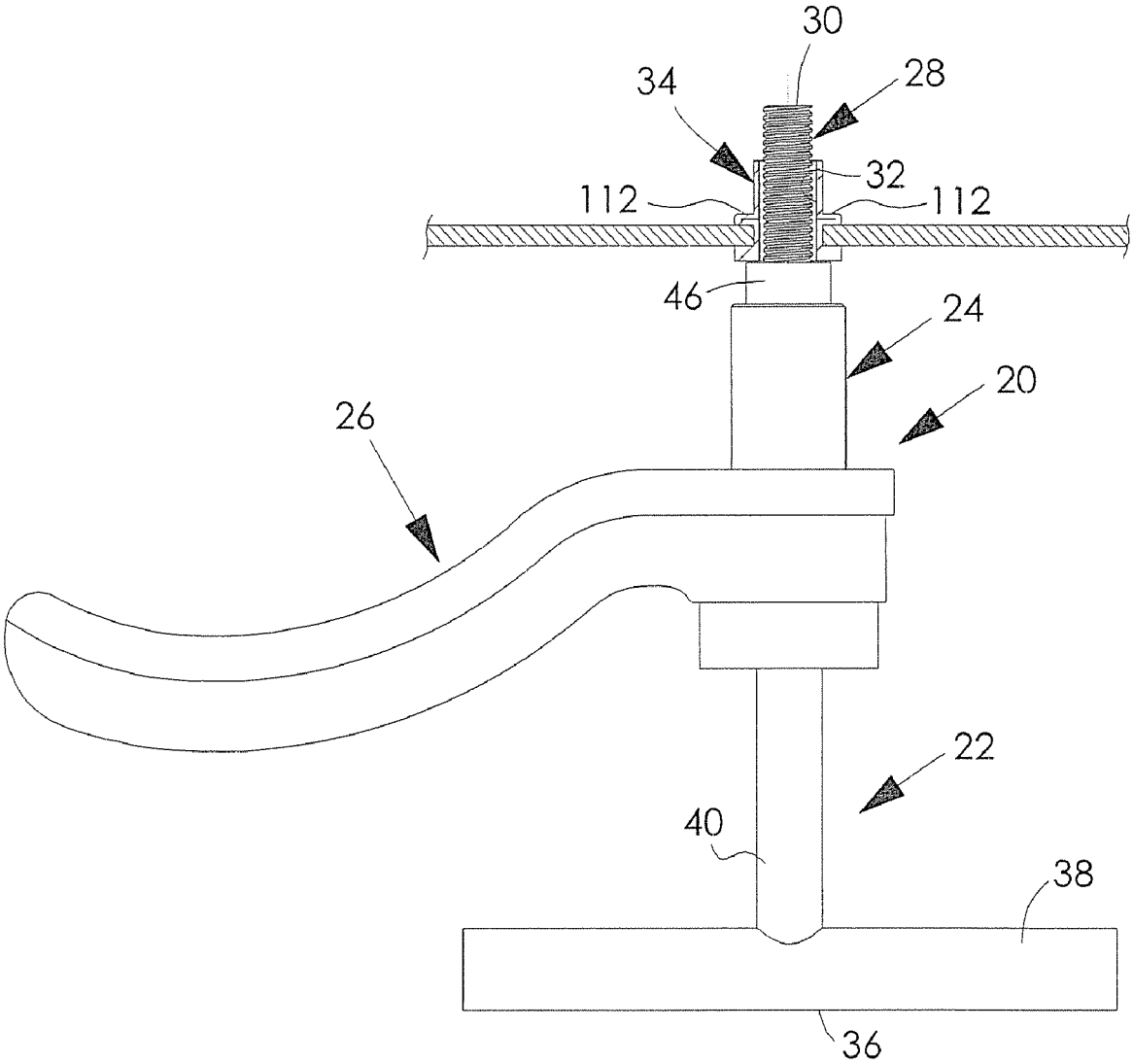
FIG. 16 provides a larger view which shows, in cross-section, the insert after it has collapsed, and shows the tool still engaged with the insert.

As shown in FIG. 15, the handle 38 of the tool shaft 22 is then rotated, while holding the stabilizing handle 26, to cause the collapsible insert 34 to collapse on the other side 110 of the workpiece 104, thereby installing the insert 34 relative to the workpiece 104. To collapse the insert 34, the handle 38 of the tool shaft 22 is rotated until very firm pressure is felt. Because the threads 44 and 56 provided on the tool shaft 22 and in the tool body 24 are left hand threads, the collapsible insert 34 is collapsed by rotating the handle 38 of the tool shaft 22 clockwise. However, the threads 44 and 56 can instead be provided as being right hand threads, in which case the collapsible insert 34 would be collapsed by rotating the handle 38 of the tool shaft 22 counter-clockwise. Regardless, the tool shaft's movement away from the workpiece 104 causes the collapsible insert 34 to be compressed which in turn spreads its four legs 112 out to "set" the insert relative to the workpiece. This "setting" is accelerated by the internal threads 32 (such as ¼-20 threads) of the collapsible insert 34 advancing up the tool shaft 22. The effect of this can be shown by the fact that it preferably takes only 3½ revolutions to fully "set" the collapsible insert 34 and it takes approximately 7½ revolutions to disengage the tool 20 from the collapsible insert 34 after the insert 34 has been installed. FIG. 16 provides a larger view which shows, in cross-section, the insert 34 after it has collapsed, and shows the tool 20 still engaged with the insert 34.

Figure 17:
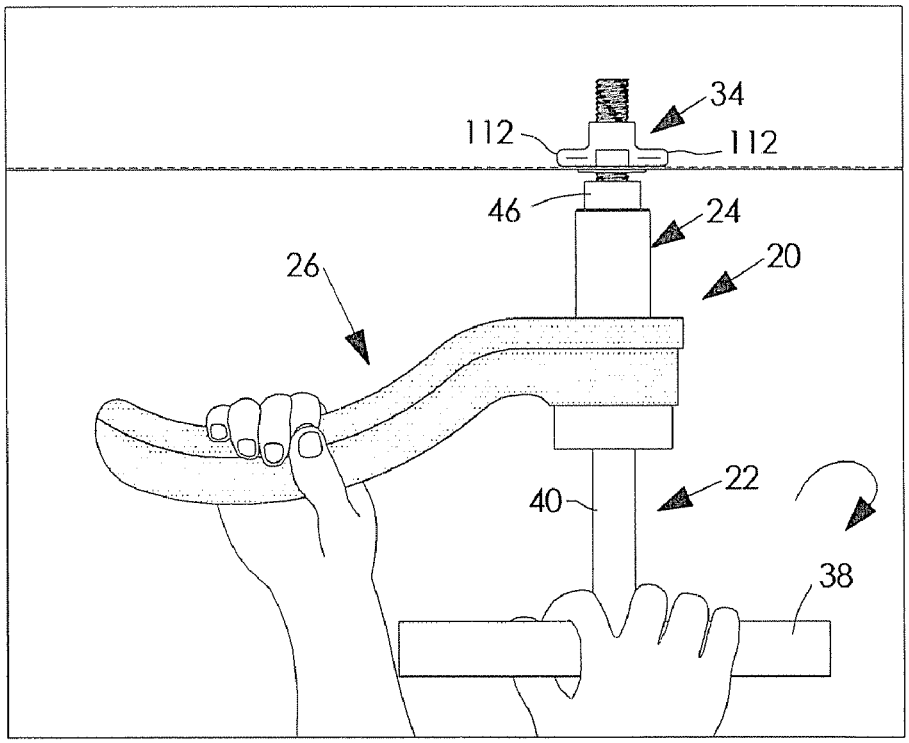
FIG. 17 shows a subsequent step of the method, wherein the tool shaft is being rotated in the opposite direction to disengage from the insert.
Figure 18:
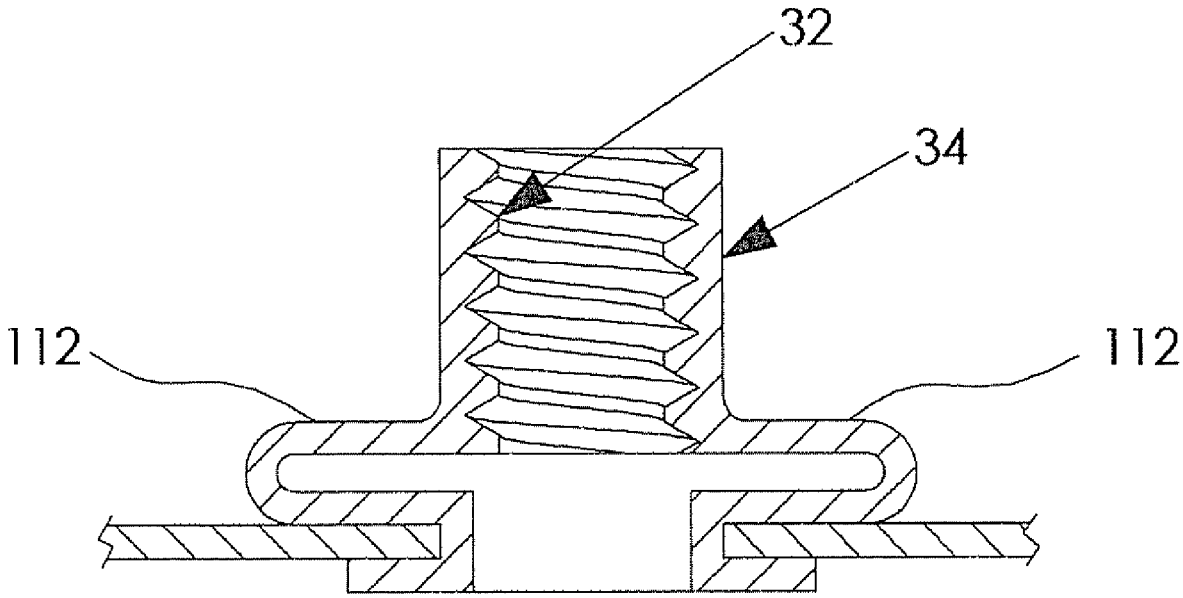
FIG. 18 provides an enlarged view, in cross-section, of the insert after it has collapsed, and after the tool has been disengaged.

As shown in FIG. 17, once the insert 34 has been collapsed using the tool 20, the handle 38 of the tool shaft 22 is rotated in the opposite direction (i.e. counter-clockwise), while holding the stabilizing handle 26, to disengage the threaded portion 28 of the tool shaft 22 from the insert 34. FIG. 18 provides an enlarged view, in cross-section, of the insert 34 after it has collapsed, and after the tool 20 has been disengaged.

Figure 19:
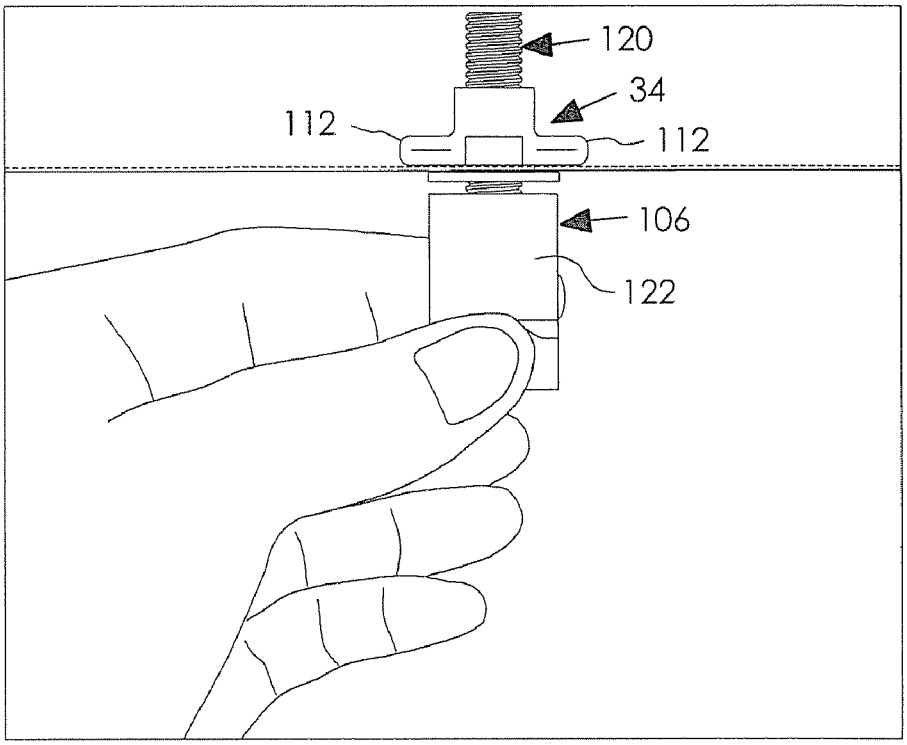
FIG. 19 shows a subsequent step which can be preformed, wherein an insert or hanger is threadably inserted into the collapsed insert.
Figure 20:
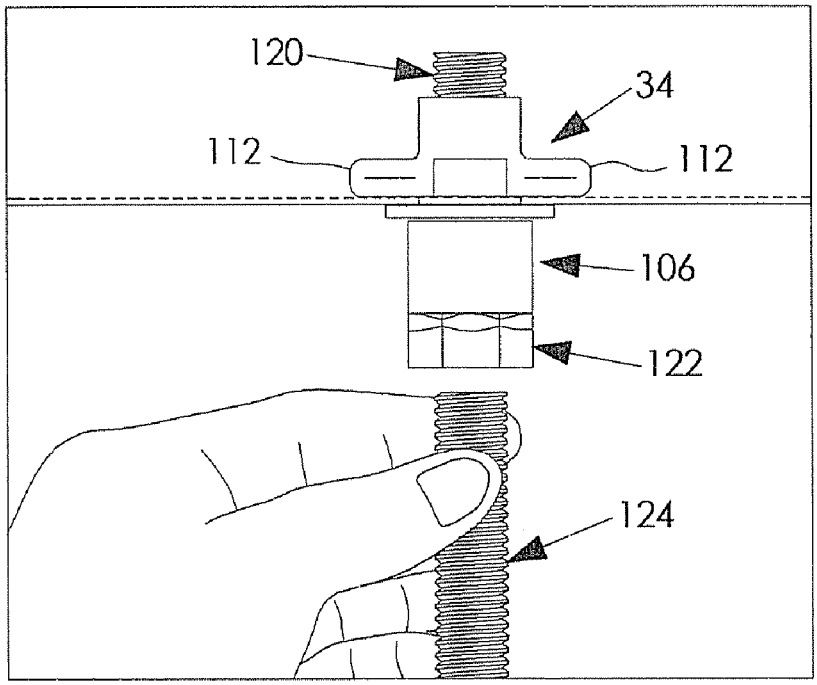
FIG. 20 shows a step subsequent to that which is shown in FIG. 19, wherein a threaded rod is threaded into the hanger.

Once the collapsible insert 34 has been collapsed or installed in the hole 102 in the workpiece 104, an insert or hanger 106 (not drawn to scale) is threadably inserted into the collapsed insert 34, as shown in FIG. 19, wherein the hanger 106 includes an externally threaded shaft portion 120 and an internally threaded head portion 122. Then, a second workpiece, such as a threaded rod 124 (not drawn to scale), is threaded into the hanger 106, as shown in FIG. 20. As an example, the hanger 106 may include ¼ inch-20 external threads and ⅜ inch-16 threads, and the collapsible insert 34 may include ¼ inch-20 internal threads.

Figure 21:
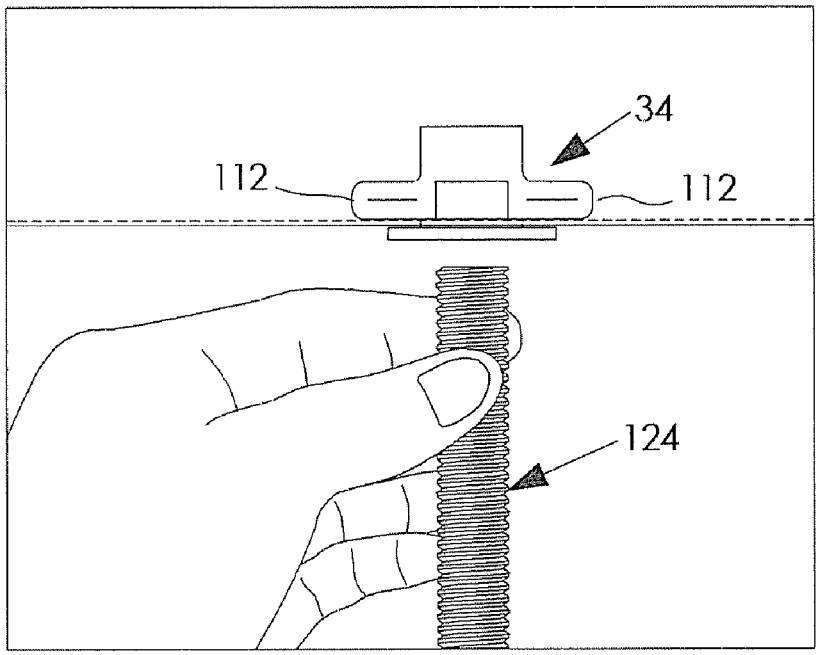
FIG. 21 shows a step which can be performed instead of that which is shown in FIGS. 19 and 20 (in cases where the dimensions of a threaded rod are consistent with the dimensions of a threaded bore of the collapsed insert), wherein the threaded rod is directly engaged with the collapsed insert without need for a hanger.

Alternatively, as shown in FIG. 21, in cases where the dimensions of the second workpiece (i.e., a threaded rod) are consistent with the threads 32 in the collapsed insert 34, the threaded rod 124 (not drawn to scale) can be directly threadably engaged with the collapsed insert 34, without need for a hanger. In the example given, this would be when the threaded rod is provided with a ⅜ inch-16 external thread.

The tool and method which have been described make it possible to quickly and easily install collapsible inserts at a construction job site, with minimal tool cost, and without having to use heavy, expensive automated equipment.

While embodiments of the present invention are shown and described, it is envisioned that those skilled in the art may devise various modifications of the present invention without departing from the spirit and scope of the disclosure.

What is claimed is:

1. A hand tool for installing a collapsible insert comprising: a sleeve having an external surface and a throughbore, a threaded portion on the external surface and a threaded portion in the throughbore; a shaft having a handle portion proximate a first end, a first threaded portion which is threadably engaged with the threaded portion in the throughbore of the sleeve, a second threaded portion proximate a second, opposite end for threadably engaging the collapsible insert, wherein threads of the first threaded portion and threads of the second threaded portion run in opposite directions; a stabilizing handle which includes a cylindrical portion and a handle portion which extends from the cylindrical portion, said cylindrical portion including a throughbore, and a threaded portion in the throughbore of the cylindrical portion of the stabilizing handle which is threadably engaged with the threaded portion on the external surface of the sleeve.

2. A hand tool as recited in claim 1, wherein said shaft and sleeve are engaged such that a clockwise rotation of the handle portion of the shaft causes the second end of the shaft to retract into the sleeve, thereby collapsing the collapsible insert.

3. A hand tool as recited in claim 1, wherein the shaft and sleeve are engaged such that it takes half the number of revolutions of the handle portion of the shaft to collapse the collapsible insert than it does to disengage the shaft from the collapsible insert after the collapsible insert has fully collapsed.

4. A hand tool as recited in claim 1, wherein said shaft and sleeve are engaged such that a clockwise rotation of the handle portion of the shaft causes the second end of the shaft to retract into the sleeve, thereby collapsing the collapsible insert, wherein the shaft and sleeve are engaged such that it takes half the number of revolutions of the handle portion of the shaft to collapse the collapsible insert than it does to disengage the shaft from the collapsible insert after the collapsible insert has fully collapsed.

5. A hand tool as recited in claim 1, wherein the shaft includes an unthreaded portion which is disposed between the first threaded portion and the second threaded portion.

6. A hand tool as recited in claim 1, wherein the shaft includes an enlarged diameter portion which is contactably engageable with the collapsible insert.

7. A hand tool as recited in claim 1, wherein the sleeve includes a shoulder which is contactably engageable with the collapsible insert.

8. A hand tool as recited in claim 1, wherein a space and a groove are provided proximate an end of the sleeve for receiving a retaining ring and a snap ring, wherein the retaining ring contains and stabilizes the shaft in the sleeve, and wherein the snap ring contains the retaining ring in the sleeve.

9. A hand tool as recited in claim 1, wherein the threaded portion on the external surface of the sleeve is only on a portion of the external surface.

10. A method of installing a collapsible insert comprising: providing a hand tool which comprises a sleeve having an external surface and a throughbore, a threaded portion on the external surface and a threaded portion in the throughbore, a shaft having a handle portion proximate a first end, a first threaded portion which is threadably engaged with the threaded portion in the throughbore of the sleeve, a second threaded portion proximate a second, opposite end for threadably engaging the collapsible insert, wherein threads of the first threaded portion and threads of the second threaded portion run in opposite directions, a stabilizing handle which includes a cylindrical portion and a handle portion which extends from the cylindrical portion, said cylindrical portion including a throughbore, and a threaded portion in the throughbore of the cylindrical portion of the stabilizing handle which is threadably engaged with the threaded portion on the external surface of the sleeve, wherein the shaft includes an enlarged diameter portion which is contactably engageable with the collapsible insert, and wherein said shaft and sleeve are engaged such that a clockwise rotation of the handle portion of the shaft causes the second end of the shaft to retract into the sleeve, thereby collapsing the collapsible insert; rotating the handle portion of the shaft of the hand tool until the second threaded portion extends out of the sleeve of the hand tool; threading the collapsible insert onto the second threaded portion of the shaft until the collapsible insert contacts the enlarged diameter portion of the shaft; rotating the handle portion of the shaft clockwise, while holding the stabilizing handle, until the collapsible insert contacts the sleeve; inserting the collapsible insert into a hole; and further rotating the handle portion of the shaft clockwise, while holding the stabilizing handle, to cause the collapsible insert to collapse.

11. A method as recited in claim 10, further comprising rotating the handle portion of the shaft in a counter-clockwise direction, while holding the stabilizing handle, to disengage the second threaded portion of the shaft from the insert.

12. A method as recited in claim 10, further comprising providing that the shaft and sleeve are engaged such that it takes half the number of revolutions of the handle portion of the shaft to collapse the collapsible insert than it does to disengage the shaft from the collapsible insert after the collapsible insert has fully collapsed.

* * * * *